US008356381B2

(12) United States Patent
Yang et al.

(10) Patent No.: US 8,356,381 B2
(45) Date of Patent: Jan. 22, 2013

(54) STRUCTURE FOR AUTOMATICALLY ROTATING A SPIRAL ROD

(76) Inventors: Ya-Ching Yang, Taipei (TW); Yi-Jun Pan, Taipei (TW)

( * ) Notice: Subject to any disclaimer, the term of this patent is extended or adjusted under 35 U.S.C. 154(b) by 271 days.

(21) Appl. No.: 12/944,733

(22) Filed: Nov. 12, 2010

(65) Prior Publication Data

US 2012/0117743 A1 May 17, 2012

(51) Int. Cl.
*A47L 13/20* (2006.01)
*A47L 13/12* (2006.01)

(52) U.S. Cl. ..... 15/229.1; 15/229.3; 15/229.7; 15/209.1

(58) Field of Classification Search ..... 15/209.1, 15/229.1, 229.3, 229.7
See application file for complete search history.

(56) References Cited

U.S. PATENT DOCUMENTS

2008/0040879 A1* 2/2008 Yang ..... 15/231

* cited by examiner

*Primary Examiner* — Monica Carter
*Assistant Examiner* — Stephanie N Berry

(57) ABSTRACT

A structure for automatically rotating a spiral rod is provided. The structure allows a dusting cloth to be turned into a spiral shape along the spiral rod by rotating a rotating element, and, while the rotating element is being rotated, a torsion spring generates a restoring torque. Once the rotating element is no longer rotated, a pulling element pressing against the teeth inside the rotating element retains the rotating element and thus keeps the dusting cloth in the spiral shape. When the pulling element is subsequently pulled away from the teeth of the rotating element, the rotating element automatically rotates in the reverse direction due to the restoring torque of the torsion spring.

9 Claims, 13 Drawing Sheets

STRUCTURE FOR AUTOMATICALLY ROTATING A SPIRAL ROD

BACKGROUND OF THE INVENTION

1. Technical Field

The present invention relates to a structure for automatically rotating a spiral rod and, more particularly, to a rod structure for twisting a cleaning cloth into a spiral shape.

2. Description of Related Art

Please refer to FIG. 1 and FIG. 2 for a conventional rotating device 1 for twisting a dusting cloth 13. After the dusting cloth 13 is mounted around the rotating plate 11, a user can hold and rotate the rotating part 12 at one end of the rotating plate 11 so that the dusting cloth 13 is twisted along the spiral ridge of the rotating plate 11 and is eventually turned into a spiral shape with a 360-degree cleaning surface, or more specifically with the fibers of the dusting cloth 13 extending in different directions. When dusting is completed, and it is desired to remove or replace the dusting cloth 13, the user must hold and rotate the rotating part 12 in the reverse direction to bring the dusting cloth 13 back to the original flat shape, thus allowing removal of the dusting cloth 13 from the spiral plate 11. However, while holding the rotating part 12, the user's hand tends to contact the dusting cloth 13 and be contaminated by the dust or other foreign matters on the dusting cloth 13.

BRIEF SUMMARY OF THE INVENTION

The primary object of the present invention is to provide a structure for automatically rotating a spiral rod such that a dusting cloth mounted around the spiral rod and a rotating element can be turned into a spiral shape by rotating the rotating element. Moreover, while the rotating element is being rotated, a torsion spring generates a restoring torque. Once the rotating element is no longer rotated, a pulling element pressing against the teeth inside the rotating element serves to retain the rotating element and keep the dusting cloth in the spiral shape. When the pulling element is subsequently moved away from the teeth of the rotating element, the rotating element automatically rotates in the reverse direction due to the restoring torque of the torsion spring and thereby brings the dusting cloth back to its original flat shape. As a result, the dusting cloth is loosened from the spiral rod and ready to be replaced.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

Figure 1:
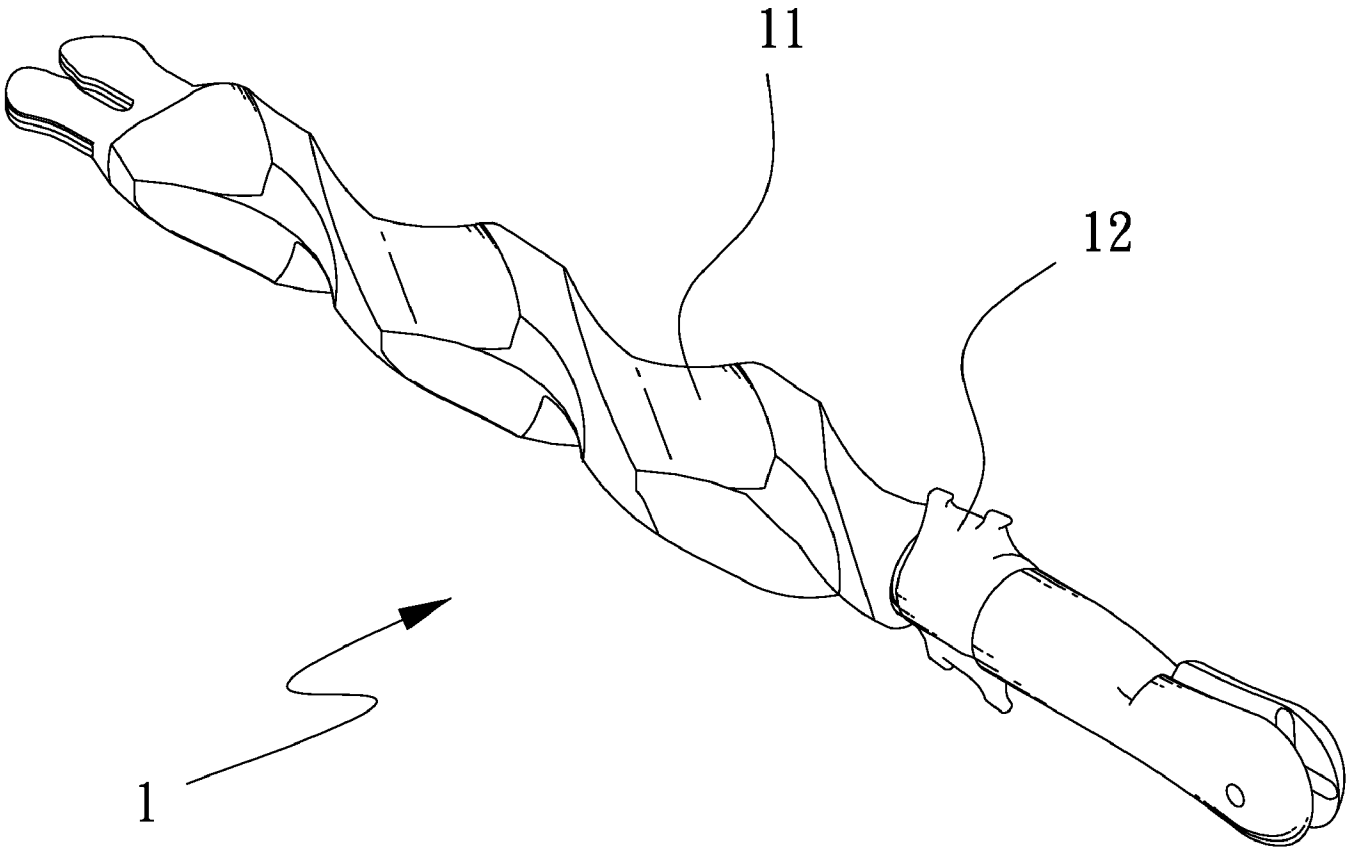
FIG. 1 is a perspective view of a conventional rotating device.
Figure 2:
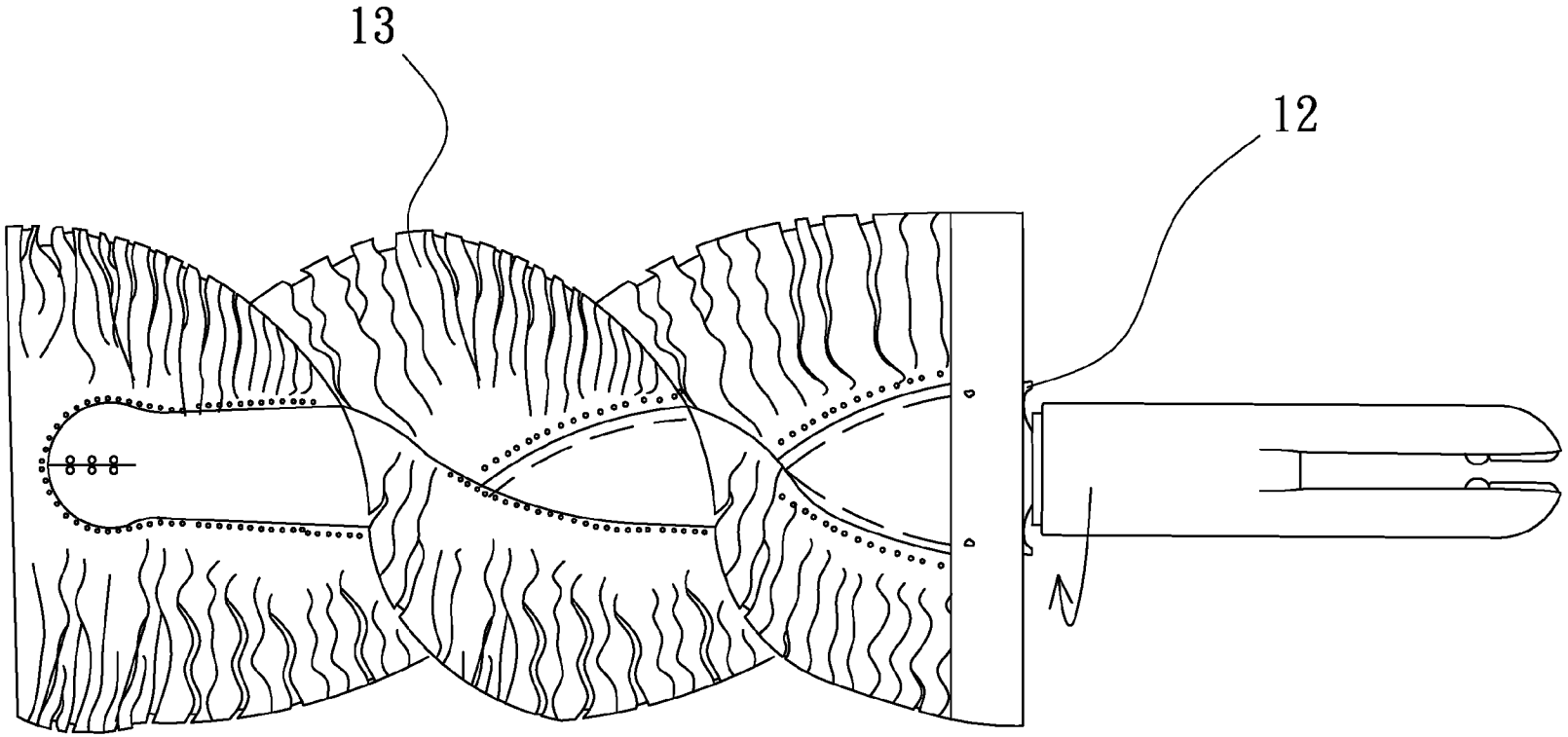
FIG. 2 shows the conventional rotating device of FIG. 1 in use.
Figure 3:
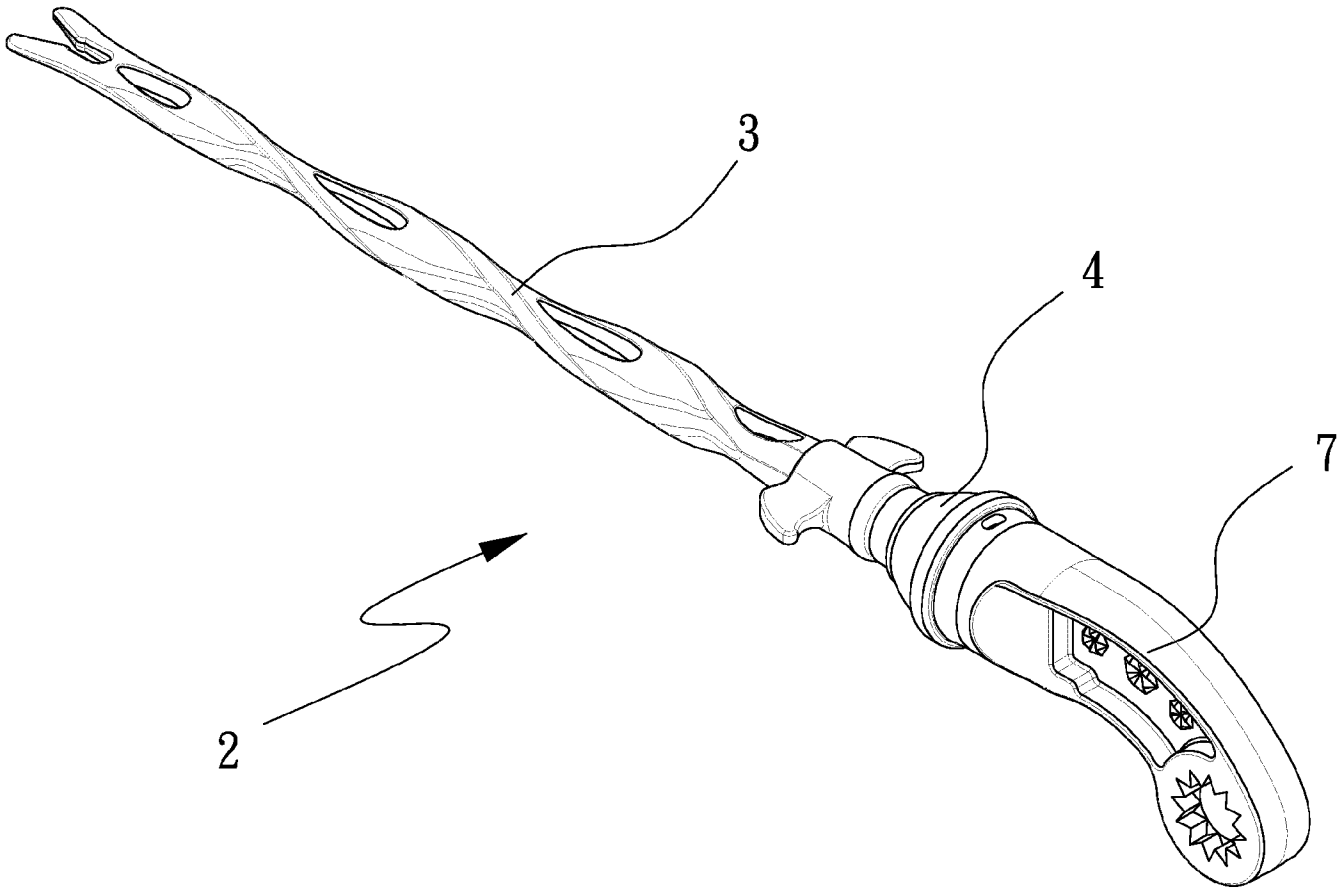
FIG. 3 is an assembled perspective view of the present invention.
Figure 4:
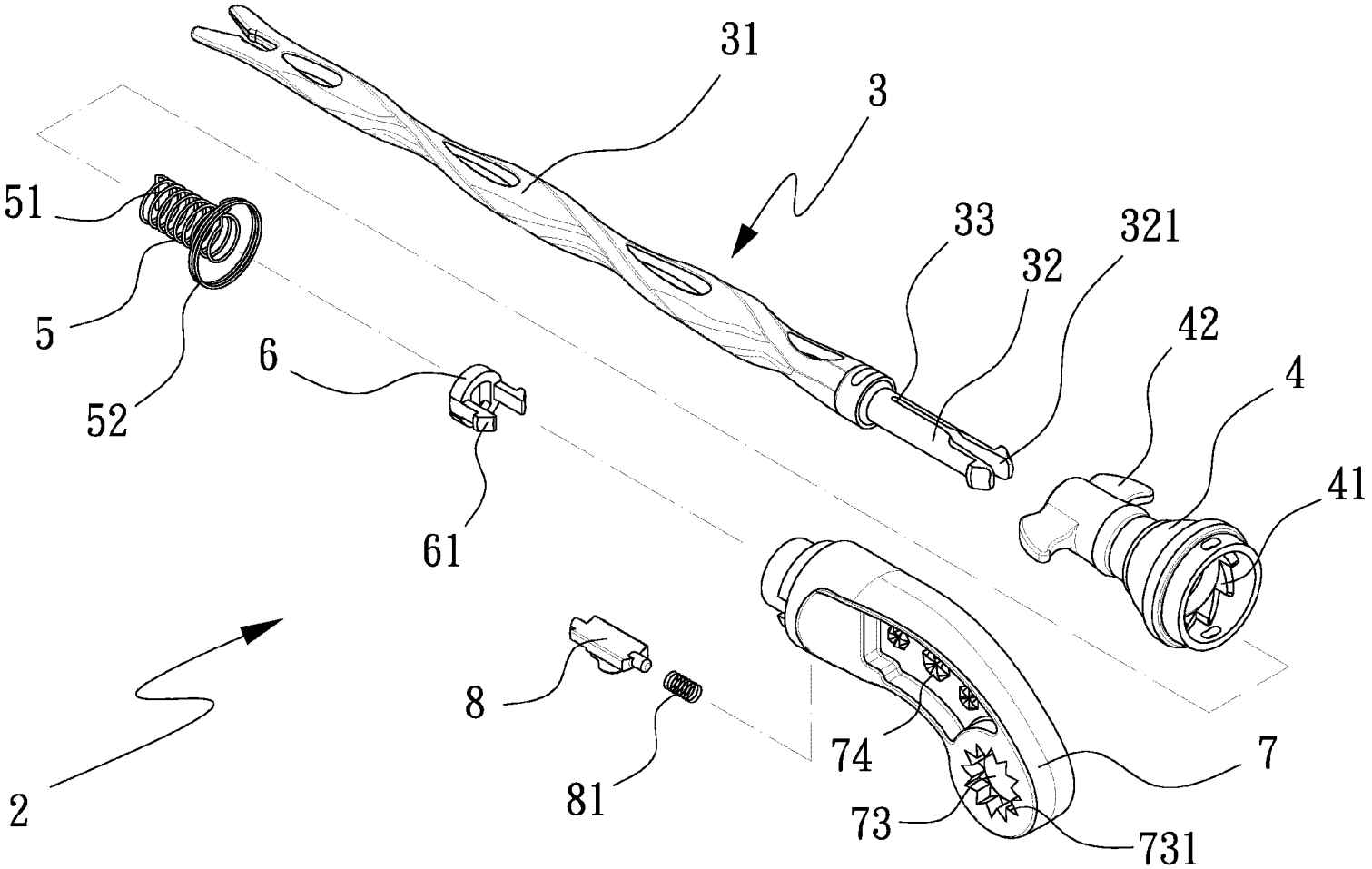
FIG. 4 is an exploded perspective view of the present invention.
Figure 5:
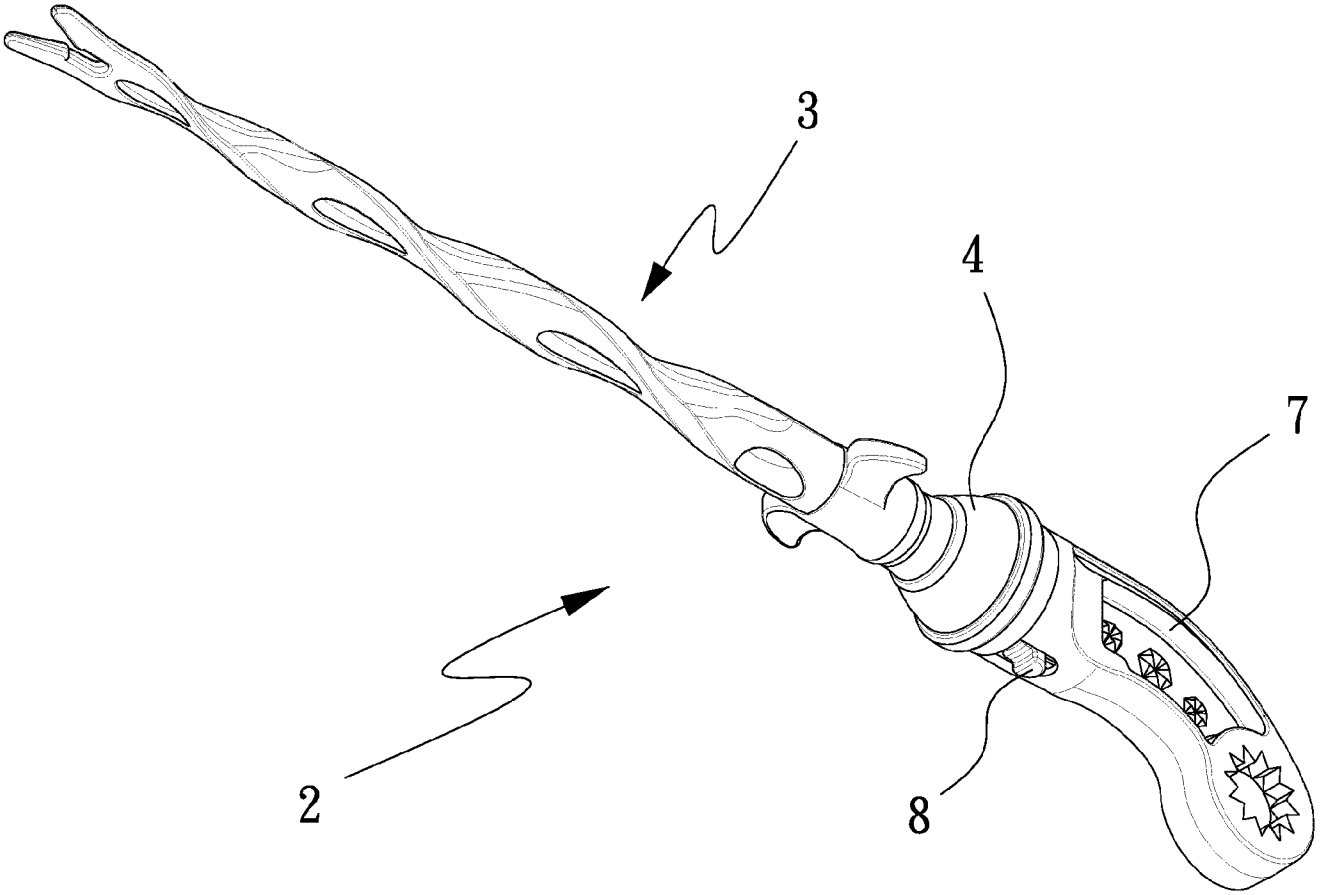
FIG. 5 is another assembled perspective view of the present invention.
Figure 6:
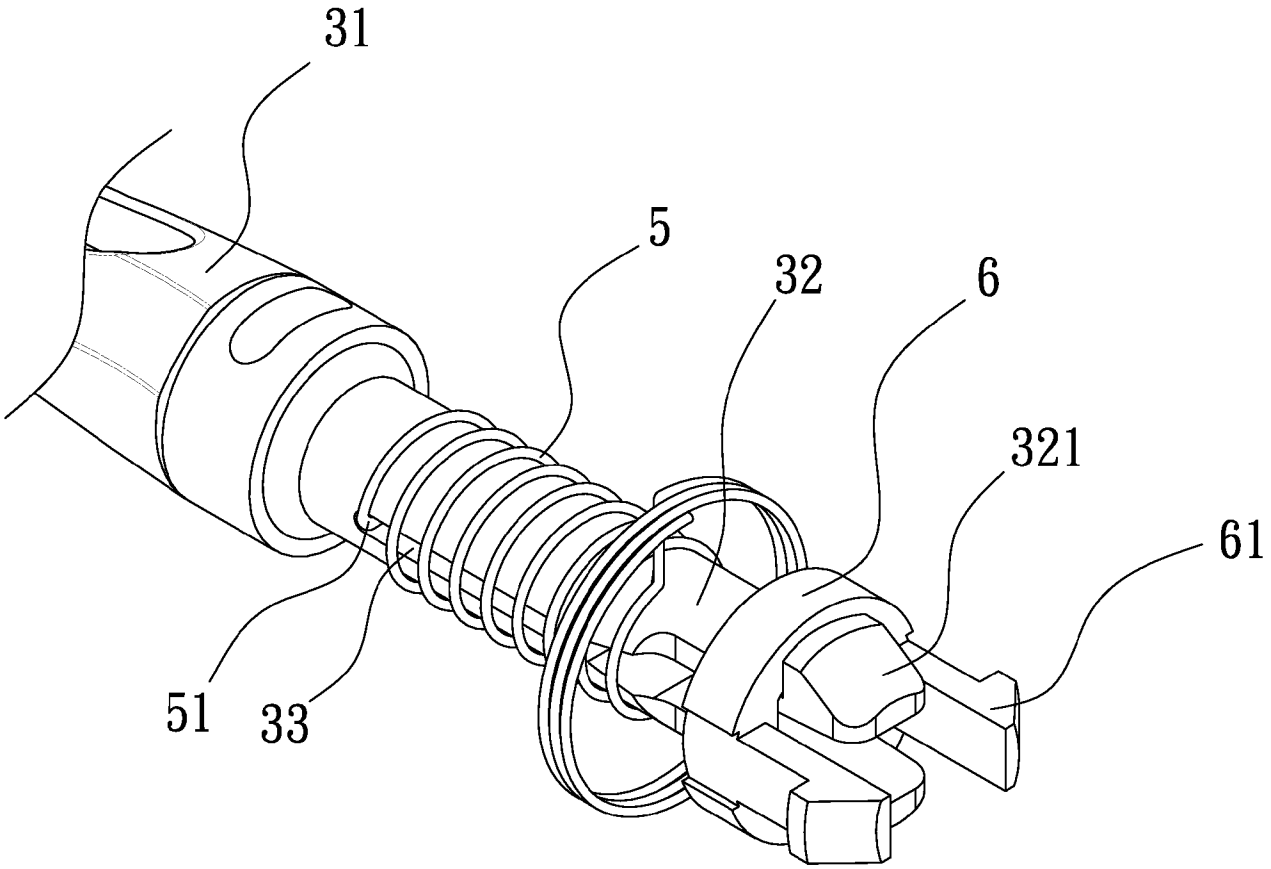
FIG. 6 is a partial perspective view of the present invention.
Figure 7:
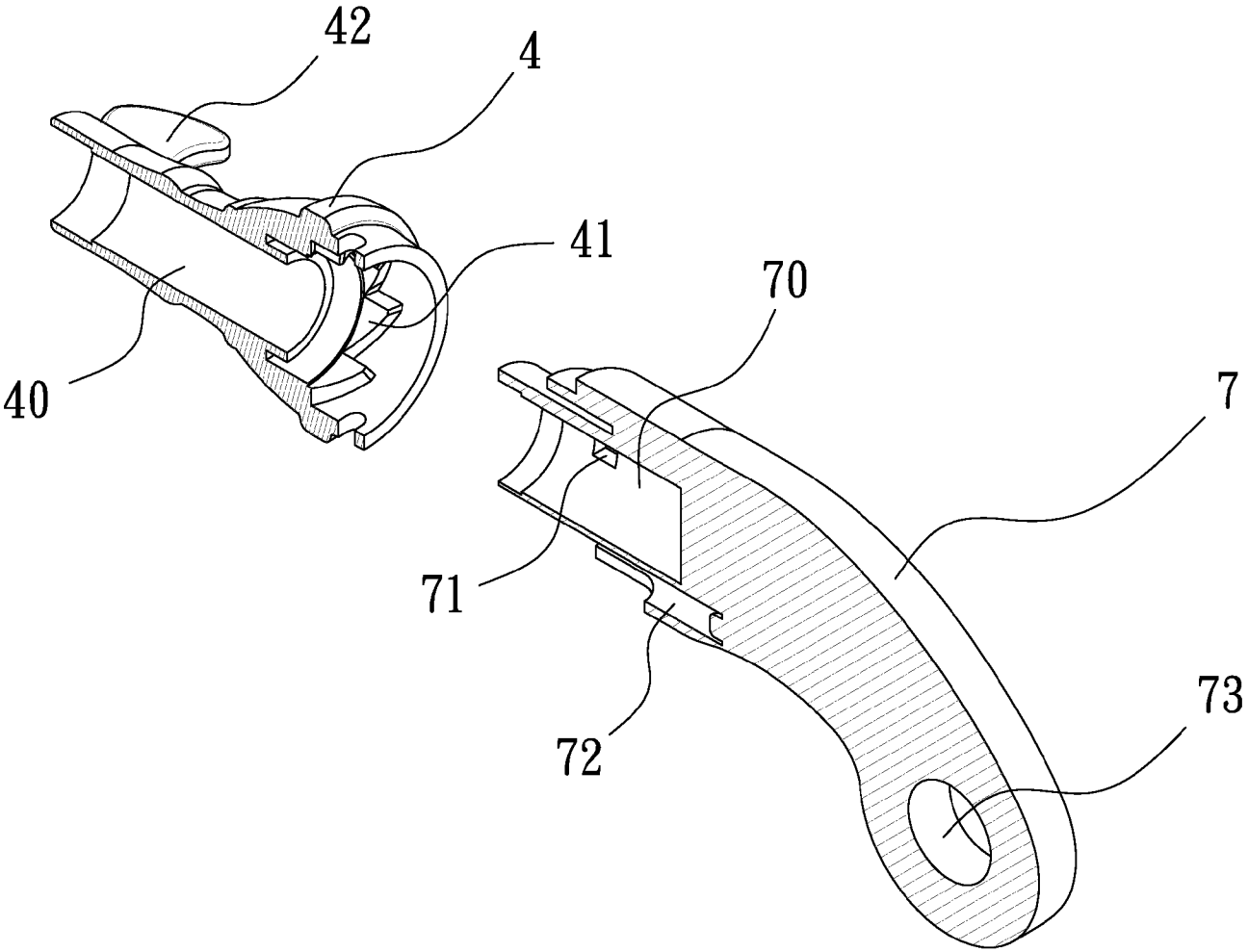
FIG. 7 is a sectional view of the present invention.
Figure 8:
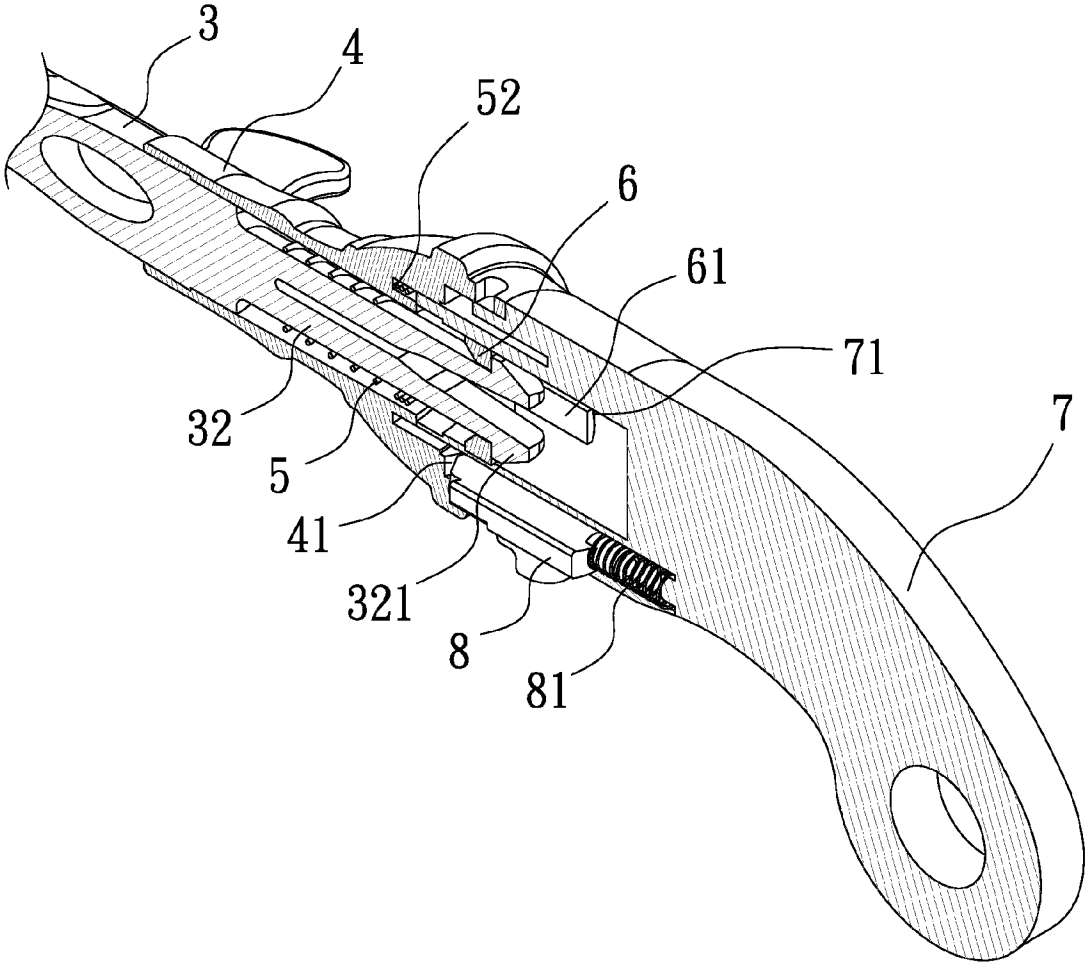
FIG. 8 is another sectional view of the present invention.
Figure 9:
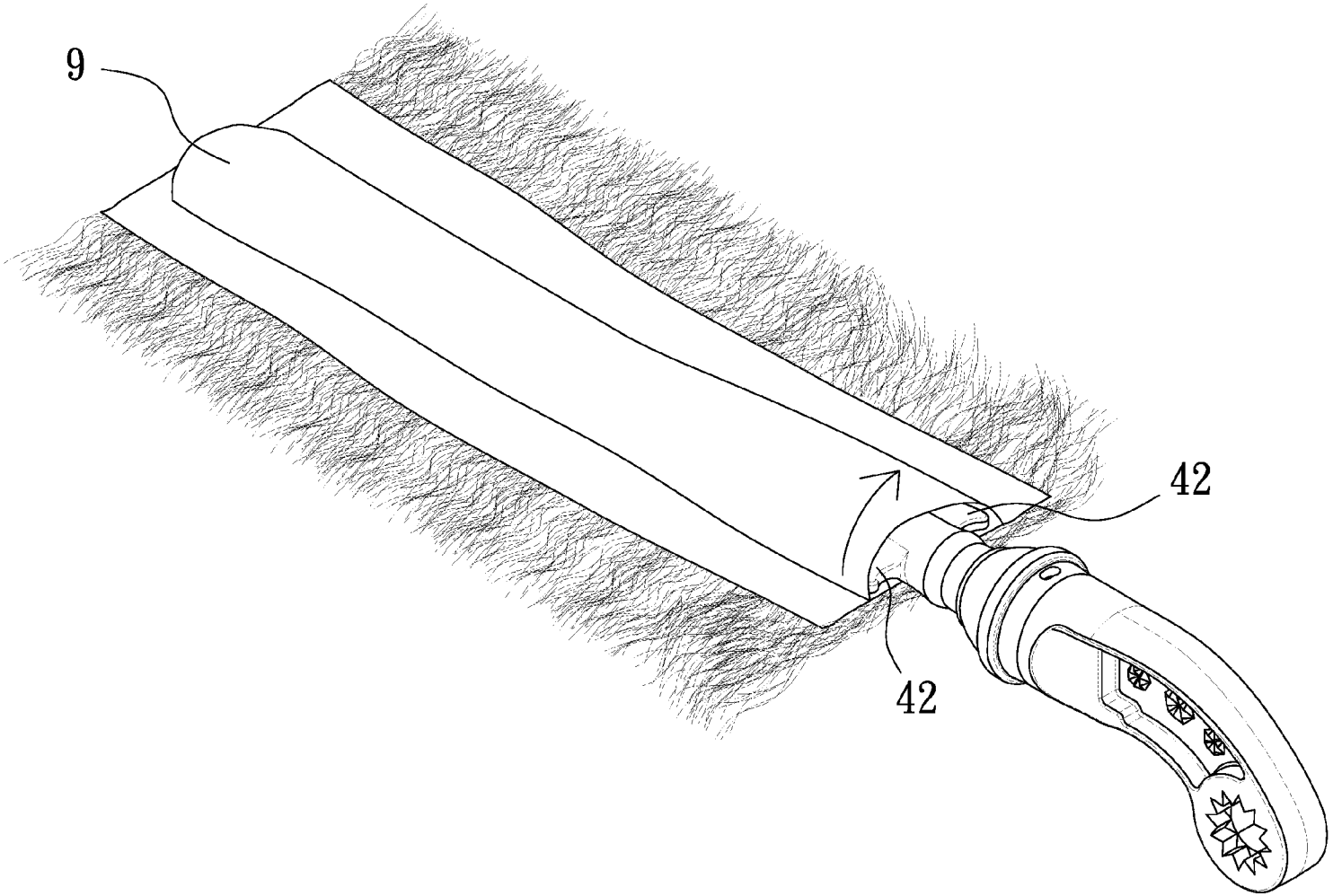
FIG. 9 is a perspective view showing the present invention in use.
Figure 10:
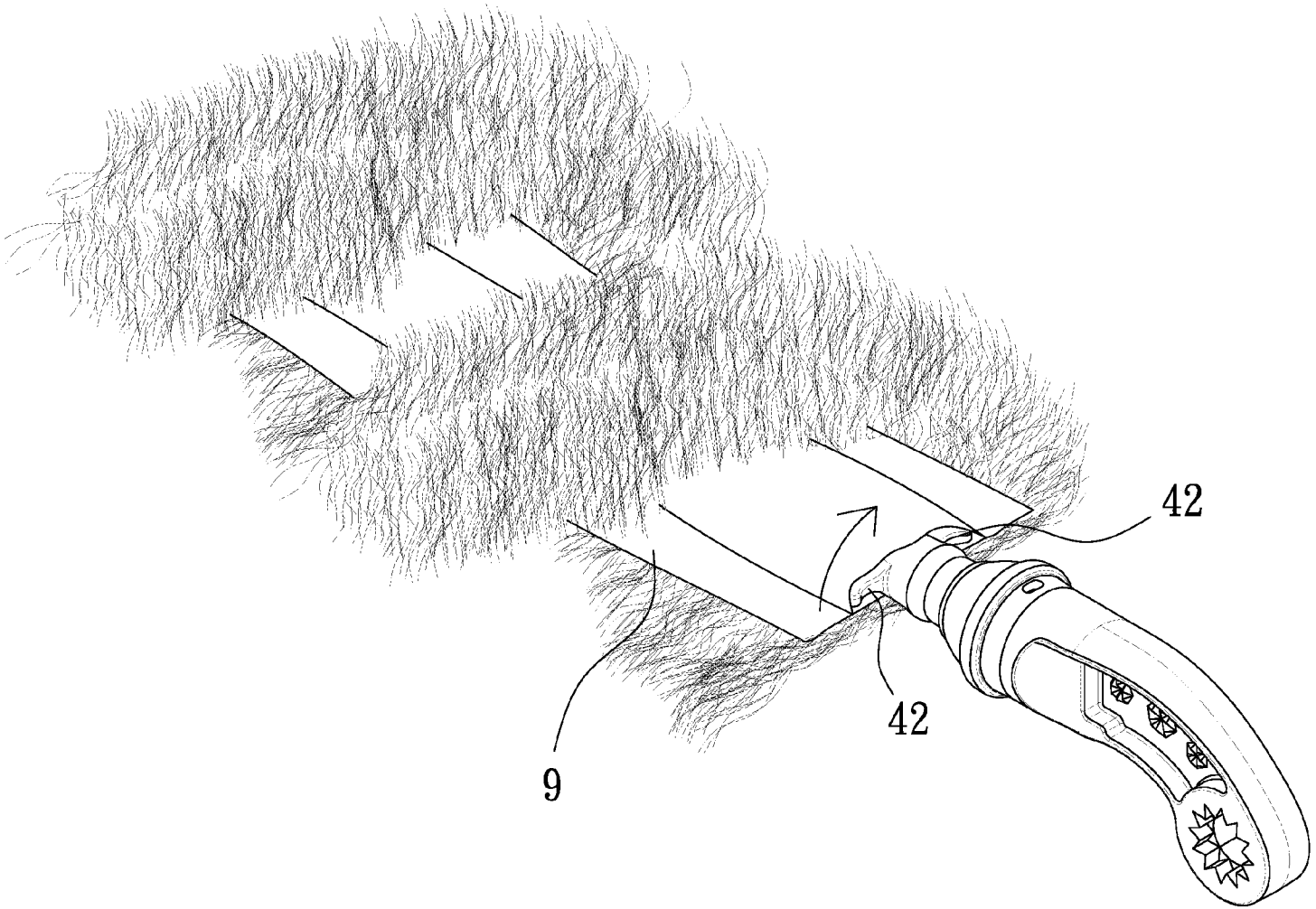
FIG. 10 is another perspective view showing the present invention in use.
Figure 11:
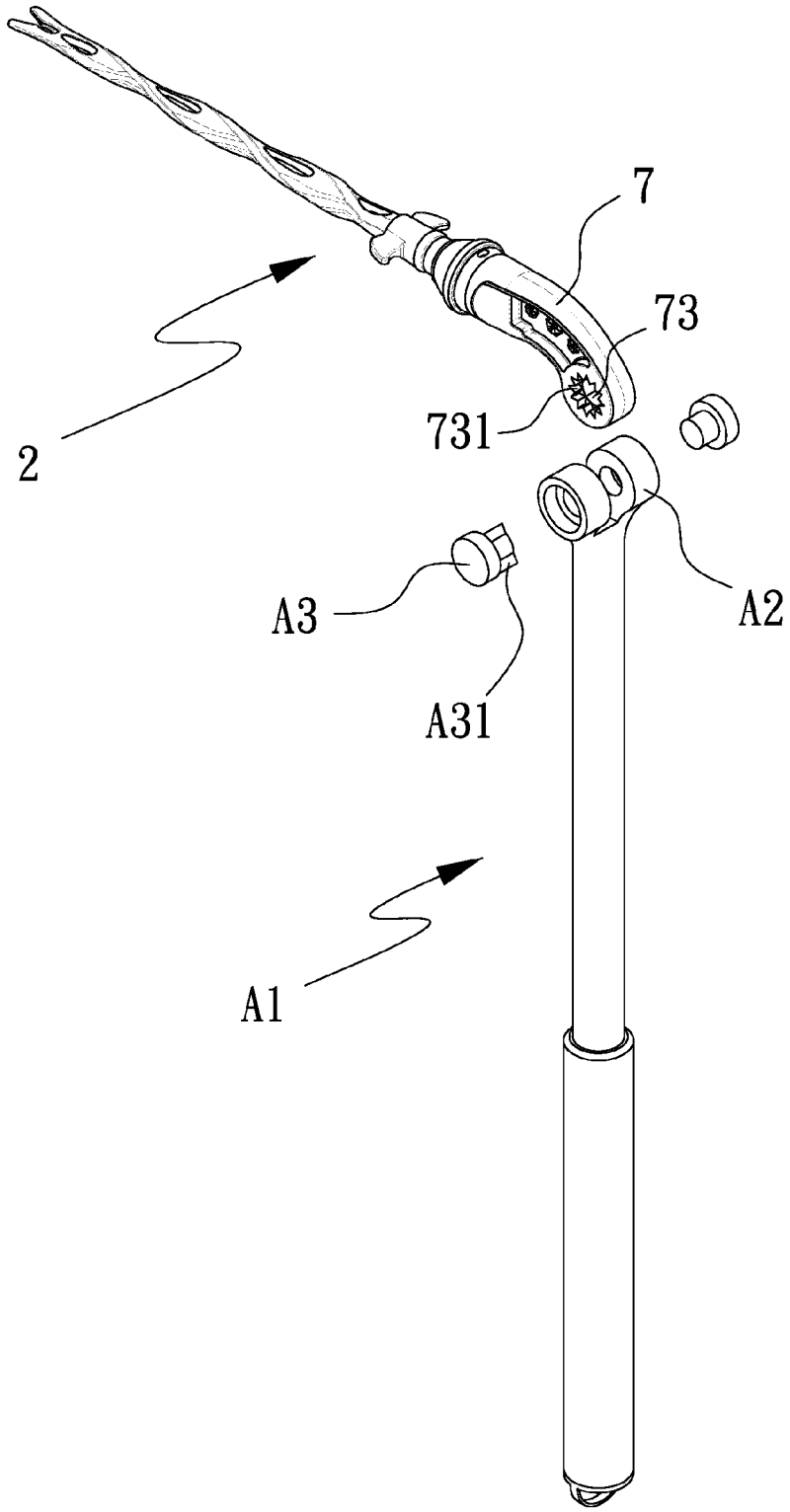
FIG. 11 is an exploded perspective view of the present invention, showing connection with a telescoping rod.
Figure 12:
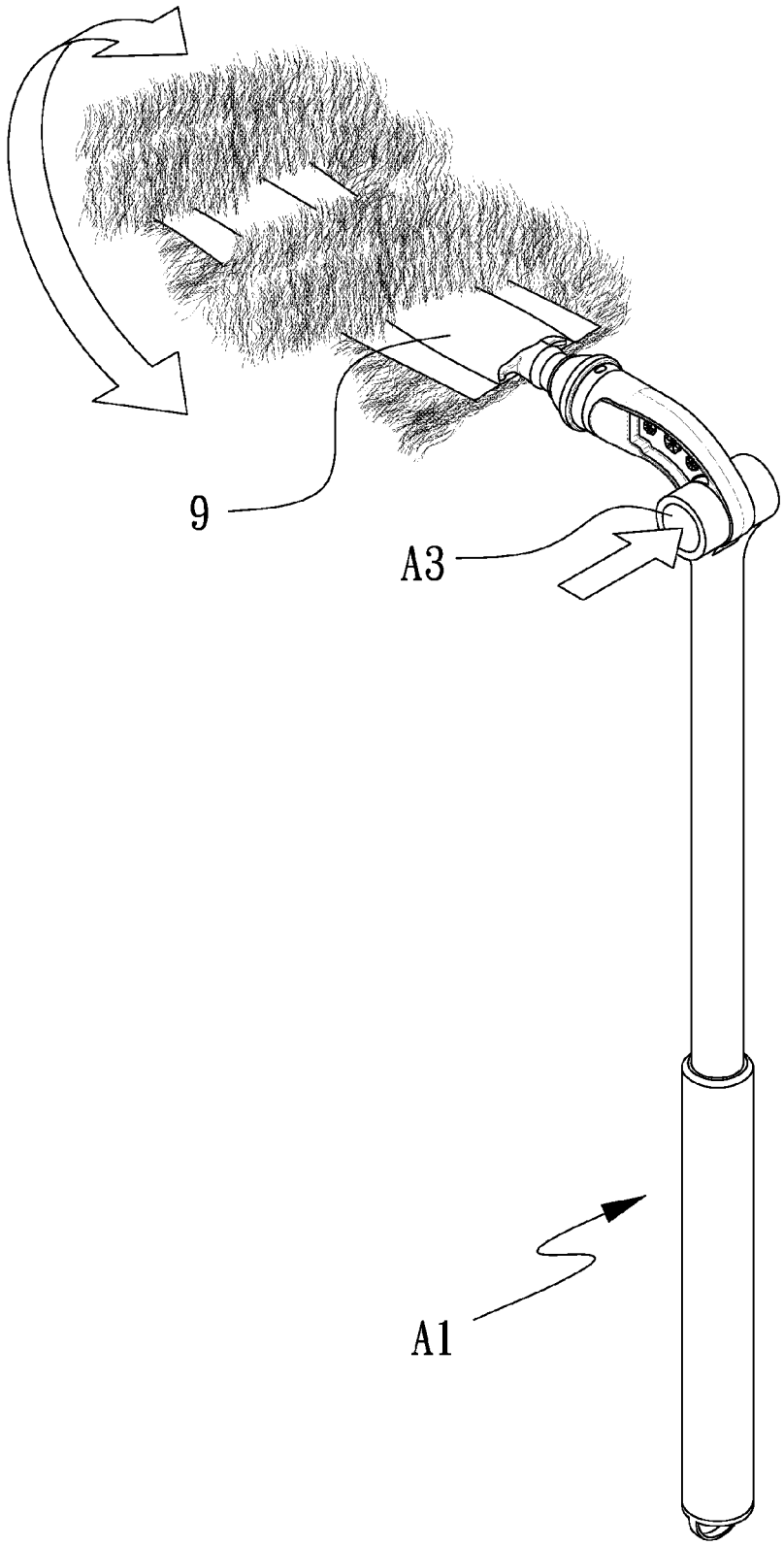
FIG. 12 is another perspective view showing the present invention in use.
Figure 13:
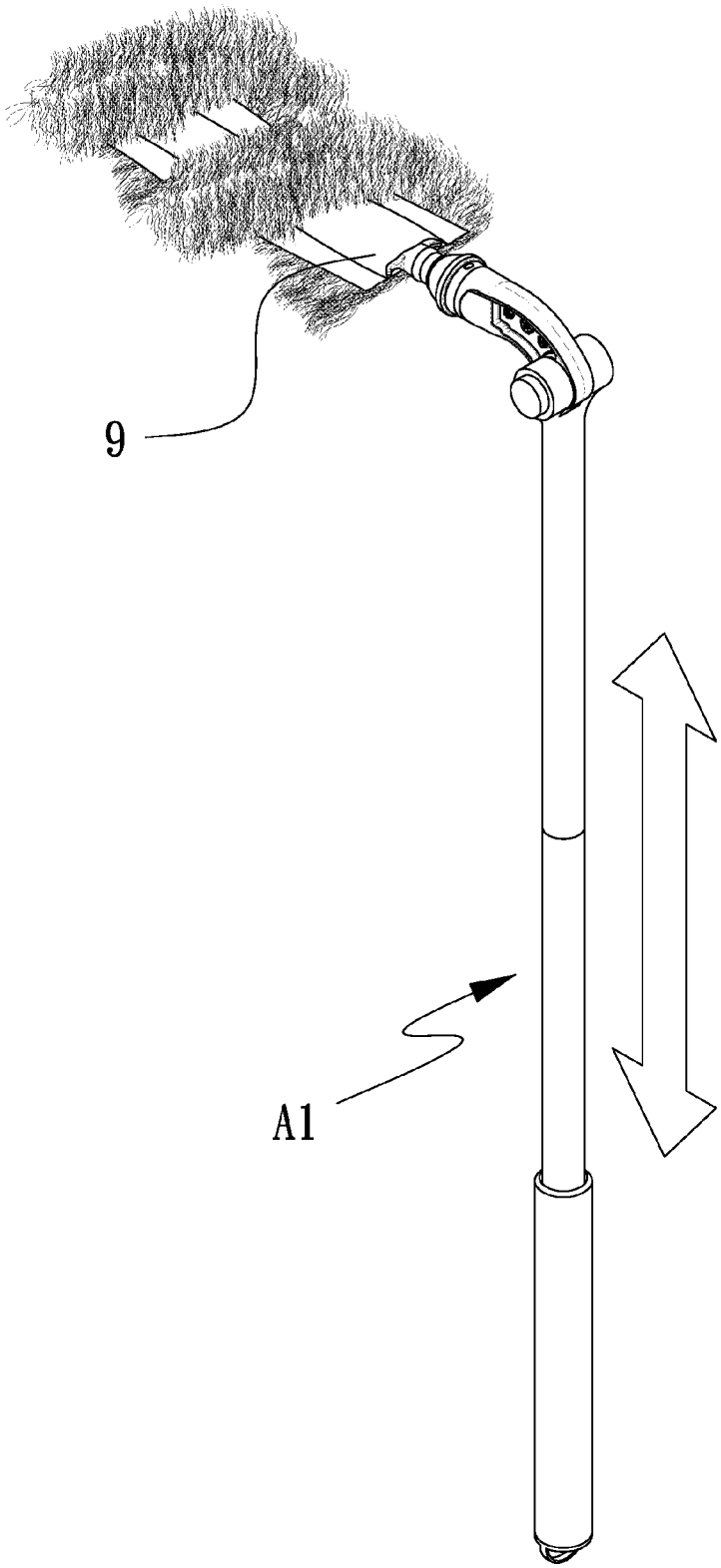
FIG. 13 is yet another perspective view showing the present invention in use.

Please refer to FIG. 3 to FIG. 13 for two assembled perspective views, two exploded perspective views, a partial perspective view, and two sectional views of the present invention, and four more perspective views showing the present invention in use. As shown in the drawings, a rotating device 2 includes a spiral rod 3, a rotating element 4, a torsion spring 5, a retaining ring 6, a base 7, and a pulling element 8.

The spiral rod 3 is composed essentially of a rod body 31. The rod body 31 is extended with an extension 32 at one end. The extension 32 has a distal end formed with two opposite engaging blocks 321. Also, the extension 32 is concavely provided with a groove 33 extending inwardly from the distal end.

The rotating element 4 is mounted around the extension 32 of the spiral rod 3 and has an inner wall circumferentially provided with teeth 41. In addition, two opposite hooks 42 are formed on the exterior of the rotating element 4.

The torsion spring 5 is mounted around the extension 32 of the spiral rod 3. The torsion spring 5 has one end formed as a bent end 51 and the other end formed as an engaging end 52. When the torsion spring 5 is mounted around the extension 32 of the spiral rod 3, the bent end 51 is located in the groove 33 of the extension 32.

The retaining ring 6 is mounted around the distal end of the extension 32 of the spiral rod 3. Two opposite protuberances 61 are extended from one side of the retaining ring 6.

The base 7 is coupled to one end of the rotating element 4 in such a way that the extension 32 of the spiral rod 3 is disposed in a receiving cavity 70 of the base 7. The receiving cavity 70 is provided therein with two opposite through holes 71 while a slide groove 72 is formed on one side of the base 7. In addition, the base 7 has two opposite surfaces, each provided with a plurality of diamond-shaped ornaments 74.

The pulling element 8 is disposed on one side of the base 7 and has one end configured for pressing against the teeth 41 in the rotating element 4. The other end of the pulling element 8 is provided with a resilient element 81.

A dusting cloth 9 is mounted around the spiral rod 3 and the rotating element 4 of the rotating device 2. By rotating the rotating element 4, the dusting cloth 9 is turned into a spiral shape along the spiral rod 3, wherein the spiral shape is advantageous in that it provides a multidirectional cleaning effect. Moreover, the rotating device 2 can be connected with a telescoping rod A1 via a fixing portion 73 formed at one end of the base 7. Thus, by holding the telescoping rod A1 at different positions, a user can extend the rotating device 2 to places of different distances from the user during the dusting process. Apart from that, a pressing portion A3 of the telescoping rod A1 enables angular adjustment of the rotating device 2, as explained further below.

After the spiral rod 3, the rotating element 4, and the base 7 are put together, the protuberances 61 of the retaining ring 6 are inserted in the through holes 71 of the base 7 respectively. Meanwhile, the bent end 51 of the torsion spring 5 is located in the groove 33 of the extension 32, and the engaging end 52 is inserted in the inner wall of the rotating element 4. Therefore, when the rotating element 4 is rotated, the bent end 51 of the torsion spring 5 is restricted by the groove 33 of the extension 32, and the opposite engaging end 52 is driven to rotate by the inner wall of the rotating element 4, causing the torsion spring 5 to generate a restoring torque. As the pulling element 8 on one side of the base 7 is biased by the resilient force of the resilient element 81 and hence presses against the teeth 41 in the rotating element 4, the rotating element 4 is kept from the restoring torque of the torsion spring 5 and stays at the rotated angle. Consequently, the dusting cloth 9 is held in the spiral shape. When it is desired to remove or replace the dusting cloth 9 after dusting is completed, the user only has to pull the pulling element 4 in the reverse direction to move the pulling element 8 away from the teeth 41 of the rotating element 4 and thereby subject the rotating element 4 to the restoring torque of the torsion spring 5. As a result, the rotating element 4 is immediately rotated in the reverse direction to its original angular position and brings the dusting cloth 9 back to its flat shape. Now that the dusting cloth 9 is loosened from the spiral rod 3, it is ready to be removed or replaced.

As mentioned previously, the rotating device 2 can be connected to the telescoping rod A1, or more specifically to a connecting end A2 thereof, via the fixing portion 73 at one end of the base 7 so that, by virtue of the telescoping function of the telescoping rod A1, the rotating device 2 can reach different heights or cover different distances during the dusting process. The aforesaid pressing portion A3 is provided at the connecting end A2 and provided with a plurality of engaging blocks A31. When it is desired to adjust the angle of the rotating device 2 with respect to the telescoping rod A1, the pressing portion A3 is pressed from the opposite side to disengage the engaging blocks A31 from inner teeth 731 of the fixing portion 73. As long as the inner teeth 731 are not restricted by the engaging blocks A31, the angle of the rotating device 2 can be adjusted as needed. When the adjustment is completed, the pressing portion A3 is pressed to push the engaging blocks A31 into engagement with the inner teeth 731. Once the inner teeth 731 are retained by the engaging blocks A31 again, further adjustment of the rotating device 2 is impossible, and the rotating device 2 is fixed at the adjusted angle.

What is claimed is:

1. A structure for automatically rotating a spiral rod, the structure comprising:

the spiral rod composed essentially of a rod body, the rod body having an end extended with an extension;

a rotating element mounted around the extension of the spiral rod and having an inner wall circumferentially provided with teeth;

a torsion spring mounted around the extension of the spiral rod;

a retaining ring mounted around a distal end of the extension of the spiral rod;

a base connected to an end of the rotating element such that the extension of the spiral rod is located in a receiving cavity of the base; and a pulling element provided on a side of the base and having an end configured for pressing against the teeth in the rotating element;

wherein a dusting cloth mounted around the spiral rod and the rotating element is turned into a spiral shape along the spiral rod by rotating the rotating element, the torsion spring generating a restoring torque while the rotating element is being rotated, the pulling element pressing against the teeth in the rotating element and thereby keeping the dusting cloth in the spiral shape once the rotating element is no longer rotated; and when the pulling element is moved away from the teeth of the rotating element, the rotating element automatically rotates in a reverse direction due to the restoring torque of the torsion spring and thereby brings the dusting cloth to a flat shape, allowing the dusting cloth to be removed from the spiral rod for replacement.

2. The structure of claim 1, wherein the extension is concavely provided with a groove extending inwardly from the distal end.

3. The structure of claim 1, wherein the distal end of the extension is formed with two opposite engaging blocks.

4. The structure of claim 1, wherein the rotating element is externally formed with two opposite hooks.

5. The structure of claim 1, wherein the retaining ring is extended with two opposite protuberances, and the receiving cavity of the base is provided with two opposite through holes in which the protuberances of the retaining ring are inserted respectively when the rotating element is connected to the base.

6. The structure of claim 1, wherein the torsion spring has an end formed as a bent end and an opposite end formed as an engaging end.

7. The structure of claim 1, wherein the side of the base is provided with a slide groove for receiving the pulling element.

8. The structure of claim 1, wherein the base has two opposite surfaces each provided with a plurality of diamond-shaped ornaments.

9. The structure of claim 1, wherein the pulling element has an opposite end provided with a resilient element.

* * * * *